United States Patent [19]

MacLeod et al.

[11] 4,125,981

[45] Nov. 21, 1978

[54] REINFORCED STRUCTURES

[75] Inventors: Colin J. MacLeod, Glasgow, Scotland; Leonard R. Creasy, Epson, England

[73] Assignee: Caledonian Moroccan Construction Ltd. S.A., Tangier, Morocco

[21] Appl. No.: 796,420

[22] Filed: May 12, 1977

[30] Foreign Application Priority Data

May 14, 1976 [GB] United Kingdom ..... 20117/76
Nov. 3, 1976 [GB] United Kingdom ..... 45768/76

[51] Int. Cl.[2] ..... E04C 2/26

[52] U.S. Cl. ..... 52/309.12; 52/334; 52/351; 52/381; 52/741

[58] Field of Search ..... 52/380, 381, 382, 383, 52/309.12, 309.7, 351, 344, 405, 454, 250, 251, 334, 741

[56] References Cited

U.S. PATENT DOCUMENTS

| | | | |
|---|---|---|---|
| 1,804,132 | 5/1931 | Tashjian | 52/334 |
| 1,968,045 | 7/1934 | Kotrbaty | 52/381 |
| 2,262,899 | 11/1941 | Mechlin | 52/405 |
| 3,305,991 | 2/1967 | Weismann | 52/309.7 |
| 3,407,560 | 10/1968 | Baumann | 52/741 |
| 3,559,355 | 2/1971 | Day | 52/645 |
| 3,879,908 | 4/1975 | Weismann | 52/309.12 |
| 3,982,368 | 9/1976 | Perrin | 52/381 |

*Primary Examiner*—John E. Murtagh
*Attorney, Agent, or Firm*—Wood, Herron & Evans

[57] ABSTRACT

This invention relates to a building structure which is made by spraying concrete onto shuttering which itself becomes incorporated into the structure. This structure has an exterior wall which comprises layers of cementitious material which have been formed by spraying that material against shuttering sheets sandwiched between the two layers, the shuttering sheets being spaced apart to define a cavity between themselves, a number of upright beams spaced from one another and each comprising one or more zig-zag reinforcing bars extending in a generally upright direction and spanning the air gap with the points of the zig-zags extending through the respective shuttering sheet and embedded within and anchored to the respective layer of cementitious material so that the two layers of cementitious material are tied together by the reinforcing bars, and at least one metal reinforcement mesh embedded within each layer of cementitious material and attached to the points of the reinforcing bars embedded within that layer.

13 Claims, 3 Drawing Figures

REINFORCED STRUCTURES

This invention relates to buildings and other types of building structures including walls, partitions and roofing. In particular the invention relates to a building structure which is made by spraying concrete onto shuttering which itself becomes incorporated into the structure.

BACKGROUND OF THE INVENTION

Conventional houses are made from bricks. The small size of each individual brick naturally limits the speed of building and brick laying itself is a highly specialised task. In addition when houses are built in this way one has to call upon a relatively large number of specialised tradesmen and, because their particular jobs often have to be completed in a certain order, this can lead to increases in costs and delays.

Concrete building structures are known and generally they have been made by pre-casting panels which are then asembled on site. Such buildings have never been satisfactory from a number of points of view including weakness in the event of failure of one or more portions and the high thermal conductivity of the wall portions. This latter property gives condensation problems in houses and flats built this way since water vapour created within the dwelling tends to condense on or within the cooler parts of the walls.

It is therefore an object of the invention to provide an improved concrete building structure, the walls of which have very low thermal conductivity and yet which can be built quickly and with a minimum number of specialised tradesmen.

BRIEF SUMMARY OF THE INVENTION

According to the invention there is provided a building structure (as herein defined), at least the exterior wall or walls of which comprise layers of cementitious material which have been formed by spraying that material against shuttering sheets sandwiched between the two layers, the shuttering sheets being spaced apart to define a cavity between themselves, a number of upright beams spaced from one another and each comprising one or more zig-zag reinforcing bars extending in a generally upright direction and spanning the air gap with the points of the zig-zags extending through the respective shuttering sheet and embedded within and anchored to the respective layer of cementitious material so that the two layers of cementitious material are tied together by the reinforcing bars, and at least one metal reinforcement mesh embedded within each layer of cementitious material and attached to the points of the reinforcing bars embedded within that layer.

When a building structure has an exterior wall as set out above, the thermal conductivity of the wall can be extremely low. Thus a cavity or air gap analogous to the cavity in conventional brick built houses is provided which is very effective in cutting down heat conductivity through the wall. In addition the material of the temporary shuttering can be chosen to have good heat insulating properties so as to reduce this thermal conductivity still further. Although the zig-zag reinforcing bars extend across the cavity and are highly heat conductive their upright cross-section is very small as compared with the overall upright cross-section of the wall and so they will conduct only a trivial amount of heat across the cavity. Also although the zig-zag points of these bars are attached to the metal mesh there is no more than point contact between them and the mesh and so heat cannot readily be collected over the whole surface of the wall by the metal mesh and transferred across the cavity by the reinforcing bars.

Because the points of the zig-zag reinforcing bars are embedded in the layers of cementitious material they anchor or tie these two layers to one another so making the wall strong and rigid. Therefore the two sprayed layers can be relatively thin, whilst still giving a very strong structure. Additionally each layer is itself made rigid by the incorporation therein of the metal reinforcement mesh.

Another advantage of the fact that both the points of the reinforcing bars and the metal mesh become wholly embedded within the sprayed cementitious material is that when this material has dried, these metal parts are not exposed to the atmosphere and therefore liable to rust which could lead both to disfiguration of the exposed surfaces of the wall and to weakening of the structure.

Also according to the invention there is provided a method of forming at least the exterior wall or walls of a building structure (as herein defined), comprising erecting on a foundation a number of spaced upright beams, each beam consisting of one or more zig-zag reinforcing bars extending in a generally upright direction, attaching shuttering sheets on either side of the beams so that the points of the reinforcing bars project through the shuttering sheets, the shuttering sheets spanning the space between adjacent beams and opposed shuttering sheets defining between themselves a cavity or air gap, attaching at least one metal reinforcement over each respective shuttering sheet and spaced therefrom to the points of the reinforcing bars projecting through that shuttering sheet, and spraying cementitious material against each shuttering sheet through the respective metal reinforcement mesh so as to form a layer against each shuttering sheet in which the metal reinforcement mesh is embedded and the points of the zig-zag reinforcing bars which project through the shuttering sheet are embedded and anchored so that the two layers of cementitious material become tied to one another by the zig-zag reinforcing bars.

Once the foundations have been laid and the beams either tied to the foundations or the lower end of the zig-zag bars embedded in the foundation, themselves straight forward jobs, the remaining jobs involved in fabricating the building structure are also relatively straight forward. Thus one first of all has to position the temporary shuttering between the beams and this can be a quick and unskilled operation followed by tying the wire mesh in place. After this it is merely a question of spraying the layers of cementitious material and this involves a single trade using well known and readily controlled techniques. Overall the number of tradesmen of differing skills required is much reduced as compared with conventional house building.

It is advantage of this manner of making building structures according to the invention that there are virtually no restraints upon the shape of the building structure which can be produced. Thus the beams can be positioned according to the final shape of the building and this shape can be a simple rectangle in plan or a complex irregular shape. Thus, since the cementitious layers are sprayed, they can follow the shape dictated by the arrangement of the beams.

The beams are substantially upright and can extend in the form of arches up side walls of the building structure and across a roof. Altlernatively the beams could extend solely from the foundations to the roof. There may be additional substantially horizontal beams which extend between the upright beams and define openings for windows, doors and the like. The arrangement of zig-zag reinforcing bars in these horizontal beams can be analogous to those in the upright beams.

The spacing between adjacent upright beams depends largely upon the choice of material for the shuttering sheets. These shuttering sheets have to withstand the spraying force of the cementitious material and so the stronger they are the further apart can be the upright beams. The metal mesh which extends over the shuttering sheets will also assist in resisting the initial force of the sprayed layers.

The walls can be completed by super-imposing a number of sprayed layers on either side of the beams once the first sprayed layer has set and the initially sprayed layers will thereafter provide the required foundation against which subsequent layers can be sprayed. In many cases, however, a single sprayed layer of cementitious material on either side of the cavity is sufficient. The final layer of material sprayed on the interior of the building structure can be plaster while the final layer of material sprayed on the exterior of the building can be given an exterior finish such as pebble dashing or alternatively a cladding layer can be fixed over the exterior surface.

As noted above the shuttering sheets are preferably of a material of low thermal conductivity. An example of one particularly preferred material is a sheet of rigid foamed plastics material, such as expanded polystyrene. The latter material is readily available in large sheets which are light and quick to position merely by forcing the points of the zig-zag bars through the material, the polystyrene sheets being kept in place until the spraying of the cementitious layer be friction. The shuttering sheets could, however, be composed of other materials such as plaster board or thick card provided suitable slots are made to receive the points of the reinforcing bars.

One or both of the initial layers of sprayed cementitious material can be fibrous concrete, i.e. concrete in which are embedded numerous fine reinforcing fibres, although this is not presently preferred. The fibre of the fibre reinforced concrete can, for example, be one or more of E glass, Alkaline resistant glass, mild steel and plastics materials such as polypropylene.

For spraying the cementitious material, whether with or without fibre reinforcement, the mixture may be pre-mixed and fed into a spray gun as a wet mix. Alternatively, a dry cement mix may be sprayed with the sumiltaneous application of water onto the surface to be sprayed. The concrete may be one part by weight of Portland cement mixed with three and a half parts by weight of sand as a base mix. The sand may be of Zone 2 fineness according to British Standard Classification. High alumina or other cements such as "Swiftcrete" or "Sulfacrete", Registered Trade Marks, may be used instead of Portland cement.

The water to cement ratio is suitably 0.5 to 0.6 by weight when the mixture is pre-mixed and fed into a spray gun as a wet mix. Alternatively, a dry cement mixture of powder or composition can be sprayed with a water to cement ratio of 0.3 to 0.4 by weight.

The fibre reinforcements in fibrous concrete can be from 1½ to 4% by weight of strands or needles of dropped mild steel or stainless steel. The strands or needles may either be in the form of closed loops having an overall diameter of maximum dimension of 2½ to 25 mm and a cross-sectional thickness of 0.25 mm, or the strands or needles may be substantially straight of a similar cross-section thickness to the loops.

Instead of or in addition to the steel needles 0.2 to 2% by weight of glass fibre in the form of substantially straight fibres having a thickness in the range 0.1 to 1 mm can be used. The glass fibres may be of E glass supplied as dropped rovings, e.g. of the type ECO 371 as sold by Turner Bros. or an alkali resistant glass, e.g. "Cemfil" as sold by Fibreglass Limited of St. Helens, England.

Further the fibre may be short lengths of a plastics material fibre such as polypropylene.

The roof of the structure according to the invention is preferably made in a manner analogous to the exterior walls since this ensures that the overall building structure has low heat losses and enables the roof to be made by the same workmen. However, the roof could instead by made by traditional methods, including setting up rafters and covering the roof with tiles.

In order to assist in defining the cavity between the shuttering sheets each beam preferably includes two zig-zag reinforcing bars which sandwich between themselves a hollow column, e.g. of rectangular horizontal cross-section, made by folding a length of metal mesh. These mesh columns will define the initial spacing between the shuttering sheets by limiting the extent to which the points of the reinforcing bars can project through the shuttering sheets.

The zig-zag bars can be of a shape such that one leg of the zig-zag extends substantially horizontally or transversely across the cavity while the other leg of the zig-zag is inclined at an angle of about 30° to it. It is preferred however, that the two legs of the zig-zag bar extend across the cavity at substantially equal angles, namely about 45°. We find that in practice this provides a diamond path in which all the legs of the bar which cross the cavity are aligned at 45° and so when combined with the sprayed cementitious layer or skins the sheer cage so constituted is then always arranged in a diamond form. Thus any rotation of the sheer cage always produces the same width of cavity void and this allows the effective development of the full strength of the structural member.

As in conventional houses the cavity which is left after the building has been completed can be filled with a low thermal conductivity foam or other material of low thermal conductivity such as particles of expanded Pearlite. Alternatively foam may be pre-positioned in this gap before the cementitious layers are sprayed.

The metal reinforcement mesh is attached to the projecting points of the reinforcing bars by, for example, tying or spot welding. The mesh should be of a mesh size which enables the sprayed cementitious material to penetrate readily through it and fill any voids, particularly between the projecting points of the zig-zag bars and the surface of the shuttering sheets so as to ensure that the reinforcing bars are anchored to the cementitious layers. However, according to a modification of the invention if the mesh is made with holes of a sufficiently small size the mesh will itself act as shuttering with a consequent elimination of the shuttering sheets. The actual mesh size is critical since if the holes are too large too much concrete will pass through the mesh and fill the cavity in an irregular manner while if they are too small the cementitious material will not pass through the mesh at all and so will not become anchored either to the mesh or to the reinforcing bars with the result that the structure will be very weak. The correct mesh size can be found by experiment and will be such that only enough cementitious material will pass through the mesh to anchor the sprayed material both to the mesh and to the projecting points of the reinforcing bars.

The invention extends to all types of buildings and building structures including bungalows, houses, flats, office buildings, factory buildings and includes individual walls, partitions and roofing. The term "building structure" as used herein therefore is intended to embrace all such items.

BRIEF DESCRIPTION OF THE DRAWINGS

A building in accordance with the invention will now be described, by way of example, with reference to the accompanying drawings, in which.

DESCRIPTION OF THE PREFERRED EMBODIMENTS

Figure 1:
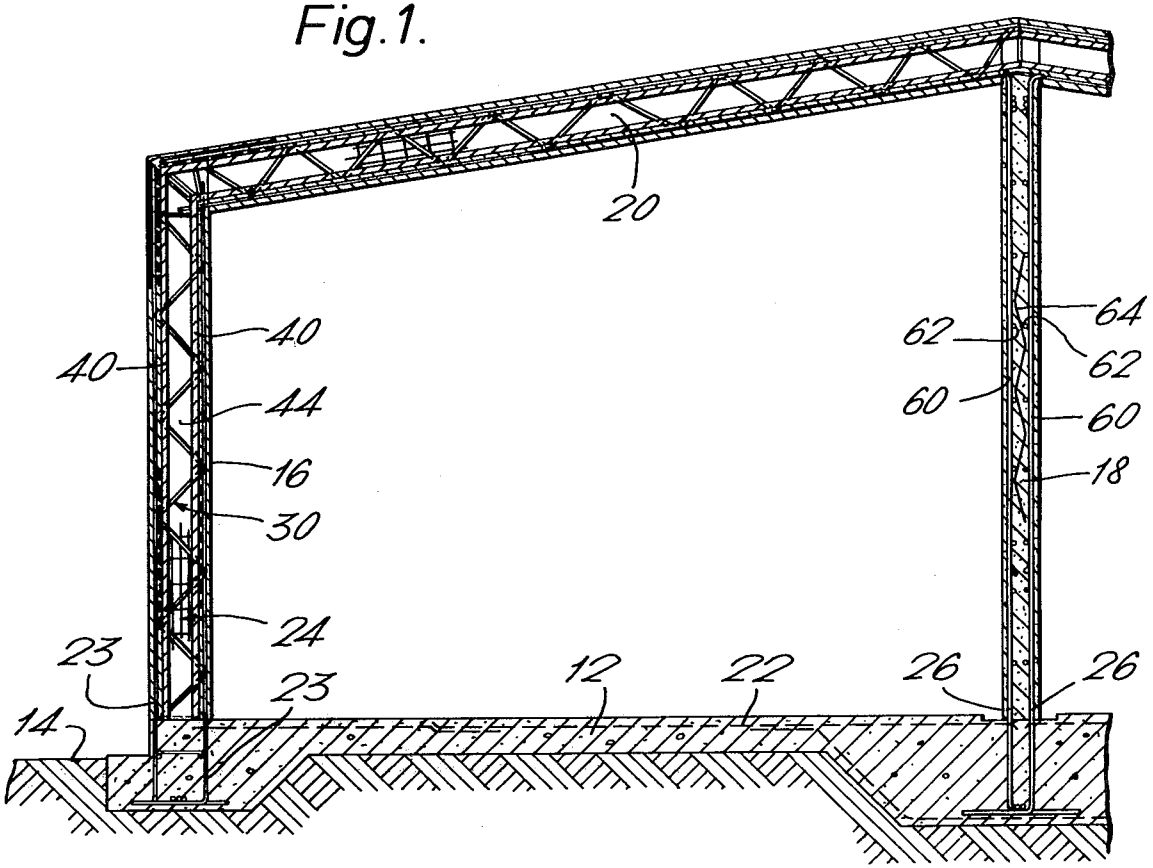
FIG. 1 is an upright section through a part of the building.
Figure 2:
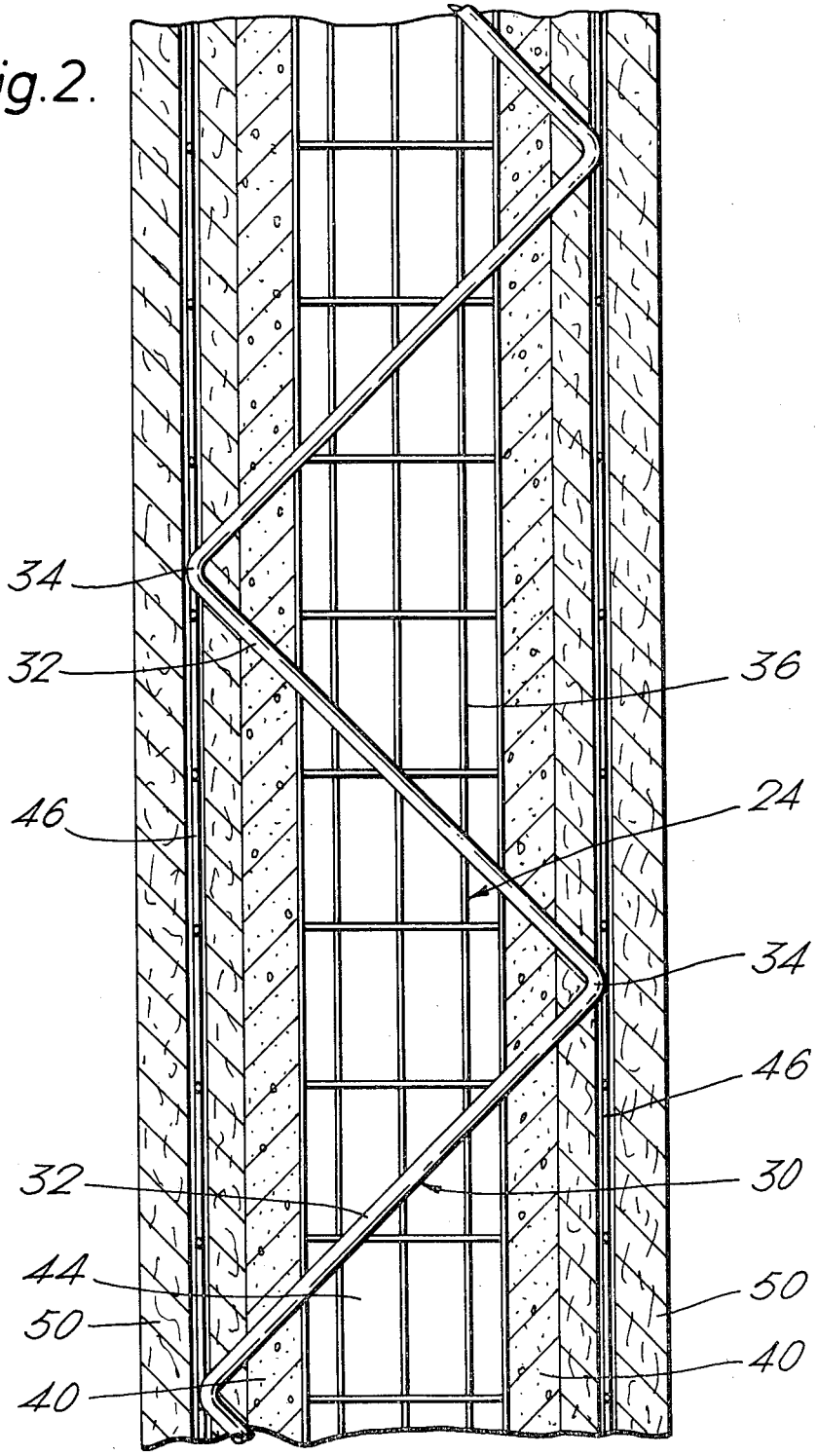
FIG. 2 is an enlarged detail of part of the exterior wall of the building shown in FIG. 1.

The building 10 shown in FIG. 1 includes a foundation 12 whose top surface is slightly above the ground level 14. The building 10 has upright exterior walls 16 whose lower ends are attached to the foundation 12 and a central internal partition wall 18 also joined to the foundation. A roof 20 extends across the top of the building from the exterior walls 16 to the partition wall 18.

The foundation 12 is in the form of a concrete raft in which are embedded metal reinforcing bars 22. Also embedded in the foundation are starter bars 23 to which are joined the lower end of beams 24 of the exterior walls. Additionally the lower ends of spaced upright reinforcing bars 26 for the central wall 18 are embedded in the foundation. A damp proof layer (not shown) is provided in conventional fashion over the top of the foundation 12.

Figure 3:
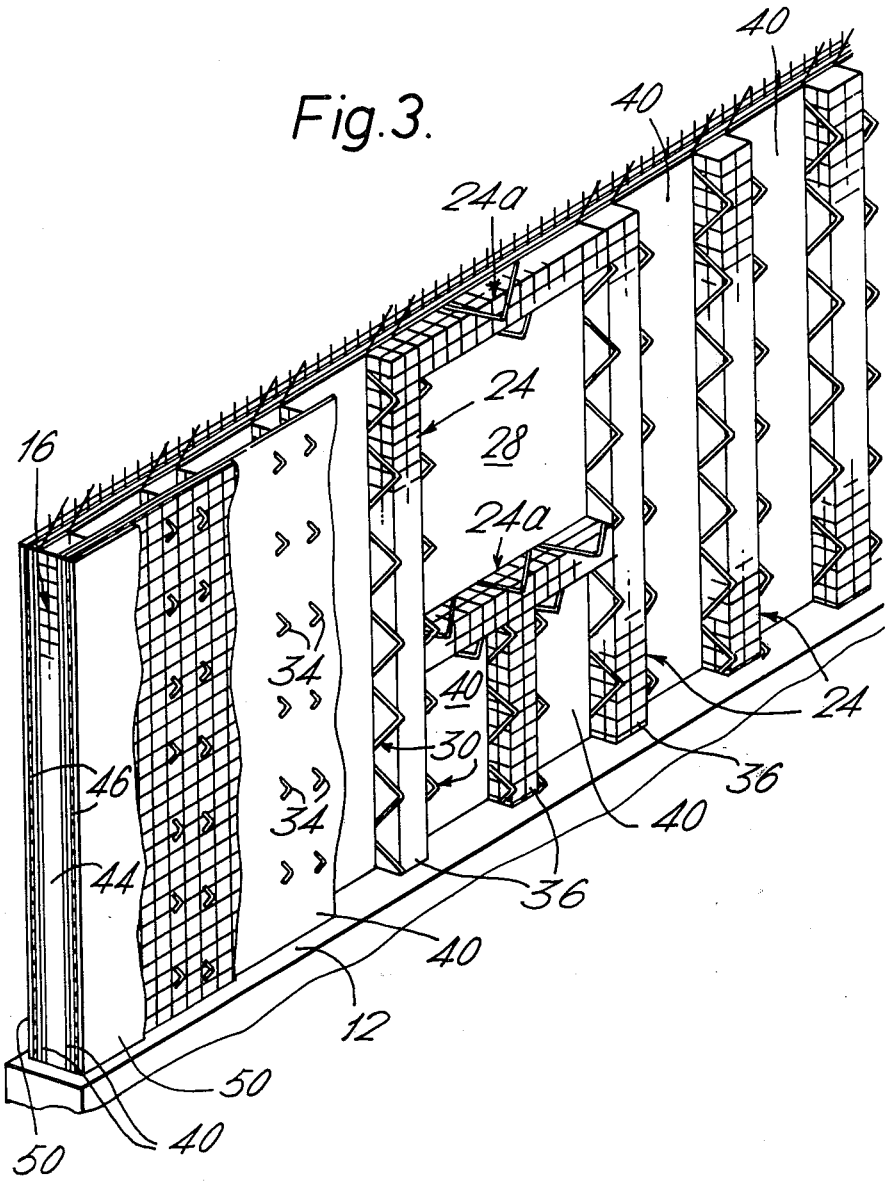
FIG. 3 is a perspective view showing a fabricated wall which is partially broken away to shown the steps in the construction of the wall.

As shown in FIG. 3 the exterior wall 16 has a number of upright beams 24 spaced from one another along the length of the wall and, between some of these upright beams, horizontal beams 24*a* are provided to define a window opening 28. Other window openings and door openings can also be provided by suitably arranging the beams 24 and 24*a*.

Each beam 24 includes a pair of metal zig-zag reinforcing bars 30. The lower ends of these bars are joined to the starter bars 23 embedded in the foundation to anchor them. Each leg 32 of the zig-zag bars is inclined at an angle of about 45° to the horizontal and adjacent legs are joined at projecting points 34. Positioned between the pair of bars 30 is a column 36 made from a folded sheet of metal mesh so that in plan view the columns are substantially rectangular.

The horizontal beams 24*a* are made in a manner indential to the upright beams 24 and differ only in their orientation and the fact that their ends are attached to beams 24 and not to the foundation 12.

To form a shuttering against which concrete can be sprayed sheets 40 of expanded polystyrene extend between adjacent beams 24 on either side of the beams. They are held in place by being pushed onto the projecting points 34 of the zig-zag reinforcing bars 30 so that the points puncture the sheets 40. The opposed sheets are urged towards one another as far as the columns 36 allow and so define between themselves an air gap or cavity 44. Once they have been positioned they will be held in place by friction with the points 34 of the reinforcing bars projecting completely through these sheets.

Next sheets of metal mesh 46 are attached to these projecting points 34 of the reinforcing bars 30 The attachment can be in any suitable fashion, such as by tying. The metal mesh 46 is attached at or near the outermost limits of the projecting points 34 so that the metal mesh 46 is spaced from the sheets 40.

Thereafter one or more layers 50 of concrete, which may or may not be fibrous concrete, are sprayed against each of the sheets 40 on each side of the cavity 44 to complete the wall 16.

The mesh 46 is chosen such that the sprayed concrete will penetrate through it both to embed the mesh and so reinforce the layers 50 and also to embed the projecting points 34 of the reinforcing bars 30 so as to tie the layers 50 together by the bars 24 and so give a strong structure. Although not shown in the drawings the exterior surface of the wall 16 can be given a suitable cladding or pebble dash finish while the interior surface can be given one or more coatings of plaster which may be sprayed or other types of interior finish such as a covering of plasterboard.

The wall 16 has a very low thermal conductivity because of the presence of the cavity or air gap 44 and the additional presence of the sheets 40 of expanded polystyrene. Although the legs 32 of the bars 30 do span the air gap they are of very small size as compared with the cross-sectional area of the cavity and in addition, because the points 34 are not in good thermal contact with the mesh 46, they cannot act as a heat drain from the whole of the interior layer 50. Therefore, problems of condensation on the interior layer 50 are very much reduced as compared with conventional concrete structures.

As will be appreciated the fabrication of the wall 16 is relatively straight forward and requires a minimum number of differing trades and skills. Thus once the foundation has been laid and the beams 24 positioned it is relativelv quick and simple to attach the sheets 40 and mesh 46 followed by spraying the required layers 50.

it is an advantage of the wall 16 according to the invention that the points of reinforcing bars 30 and the mesh 46 are totally embedded in concrete. They are therefore not liable to rust which could both seriously weaken the wall with time and stain the faces of the walls.

The building shown in FIG. 1 has an internal wall 18 composed for examaple of upright reinforcing bars 60 joined to the bars 26, and horizontal reinforcing bars 62 held apart by a central snake 64. All of these reinforcing bars are then embedded in concrete which will preferably have been sprayed against temporary shuttering (not shown) so as to avoid the use of additional skilled labourers, e.g. bricklayers.

Although not essential it is preferred that the roof 20 be made in a manner identical to the exterior wall 16 since this again reduces the number of trades which need to be present on the building site. It also ensures that the roof, through which in conventional buildings there can often be large heat losses, has a very low thermal conductivity matching that the of walls 16.

For simplicity only approximately one half of the building 20 is shown in FIG. 1. The remaining half not shown can be substantially identical with the half which is shown but will be a mirror image thereof.

We have found that according to an alternative embodiment according to the invention the shuttering sheets 40 of expanded polystyrene can be eliminated provided the mesh size of the metal mesh 46 is carefully chosen. Thus if the mesh is made with holes of a sufficiently small size the mesh itself will act as shuttering. If the mesh size is too large too much concrete will pass through the mesh and fill the cavity or air gap 44 in an irregular manner, while if the holes in the mesh are too small the concrete will not penetrate the mesh at all and so will not become anchored either to the mesh 46 or to the projecting points 34 of the reinforcing bars 30 and so the resulting structure will then be very weak. Provided the correct hole size for the metal mesh 46 is chosen, and this can be found by simple experiment, enough sprayed concrete will pass through the mesh to anchor the sprayed concrete both to the metal mesh 46 and to the projecting points 34 without at the same time filling the cavity.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

What we claim is:

1. A building structure having at least one exterior wall which comprises (a) spaced shuttering sheets (b) a cavity defined between said spaced apart shuttering sheets, (c) two layers of cementitious material which have been formed by spraying said cementitious material against said shuttering sheets, (d) a number of upright beams spaced from one another and each comprising one or more zig-zag reinforcing bars extending in a generally upright direction and spanning the cavity, each upright beam additionally including an upright column of metal mesh folded to give a rectangular horizontal cross-section, that column acting as a spacer between said shuttering sheets to define said cavity, (e) said reinforcing bars having points of the zig-zags extending through the respective shuttering sheet and embedded within and anchored to the respective layer of cementitious material so that said two layers of cementitious material are tied together by the reinforcing bars, and (f) at least one metal reinforcement mesh embedded within each layer of cementitious material and attached to said points of the reinforcing bars embedded within that layer.

2. A building structure according to claim 1 in which at least some of the beams are in the form of arches extending up side walls of said building structure and across the roof of said building structure.

3. A building structure according to claim 1 in which there are additional substantially horizontal beams extending between said upright beams so as to define openings for doors, windows and the like, each substantially horizontal beams comprising one or more zig-zag reinforcing bars extending in a generally horizontal direction and spanning said cavity and said reinforcing bars having points of the zig-zags extending through the respective shuttering sheet and embedded within and anchored to the respective layer of cementitious material.

4. A building structure according to claim 1 in which each metal reinforcement mesh is tied with wire to said points of said reinforcing bars embedded within said layer of cementitious material in which that sheet of mesh is embedded.

5. A building structure according to claim 1 in which each zig-zag reinforcing bar includes alternate oppositely inclined lengths, the oppositely inclined lengths being arranged at substantially identical angles to the upright direction.

6. A building structure according to claim 5 in which each length of the zig-zag reinforcing bars is inclined at an angle of about 45° to the upright.

7. A building structure according to claim 1 in which said shuttering sheets are sheets of expanded polystyrene.

8. A building structure having at least one exterior wall which comprises:

(a) spaced metal reinforcement meshes, (b) a cavity defined between said spaced apart reinforcement meshes, (c) two layers of cementitious material which have been formed by spraying said cementitious material against said metal reinforcement meshes, the mesh size of said metal reinforcement meshes being such that some sprayed cementitious material has passed through said mesh and so said mesh has become anchored to the mesh without filling said cavity, (d) a number of upright beams spaced from one another and each comprising one or more zig-zag reinforcing bars extending in a generally upright direction and spanning said cavity, each upright beam additionally including an upright column of metal mesh folded to give a rectangular horizontal cross-section, that column acting as a spacer between said shuttering sheets to define said cavity, (e) said reinforcing bars having points of the zig-zags embedded within and anchored to the respective layer of cementitious material so that said two layers of cementitious material are tied together by the reinforcing bars.

9. A building structure at least one exterior wall which comprises:

(a) a cavity, (b) spaced shuttering sheets of expanded polystyrene defining said cavity between themselves, (c) layers of cementitious material which have been formed by spraying said cementitious material against respective shuttering sheets, said layers sandwiching said cavity and shuttering sheets, (d) a number of upright beams spaced from one another and extending across said cavity, said beams comprising a pair of zig-zag reinforcing bars extending side by side in a generally upright direction and an upright column of metal mesh folded to give a rectangular horizontal cross-section, the column acting as a spacer between said shuttering sheets and being positioned between said side by side reinforcing bars, (e) each of said reinforcing bars including alternate oppositely but substantially equally inclined to the horizontal lengths and points joining adjacent oppositely inclined lengths, lengths extending across said cavity and said points extending through the respective shuttering sheet and being embedded within and anchored to the respective layer of cementitious material so that said two layers of cementitious material are tied together by said reinforcing bars, and (f) at least one metal reinforcement mesh embedded within each layer of cementitious material and attached to said points embedded within that layer.

10. A method of forming at least the exterior wall or walls of a building structure comprising:

(a) erecting on a foundation a number of spaced upright beams, each beam including one or more zig-zag reinforcing bars extending in a generally upright direction, each beam also including an upright column of metal mesh folded to give a rectangular horizontal cross-section, (b) attaching shuttering sheets on either side of said beams so that the points of the reinforcing bars project through the shuttering sheets, the shuttering sheets spanning the space between adjacent beams and opposed shuttering sheets defining between themselves a cavity, and said shuttering sheets abutting said column so that it acts as a spacer between said shuttering sheets, (c) attaching at least one metal reinforcement mesh over each respective shuttering sheet to the points of the reinforcing bars projecting through that shuttering sheet, and (d) spraying cementitious material against each shuttering sheet through the respective metal reinforcement mesh so as to form a layer against each shuttering sheet in which the metal reinforcement mesh is embedded and the points of the zig-zag reinforcing bars which project through the shuttering sheet are embedded and anchored so that the two layers of cementitious material become tied to one another by the zig-zag reinforcing bars embedded within that layer.

11. A method according to claim 10 in which each metal reinforcement mesh is tied to the respective projecting points of said reinforcing bars.

12. A method of forming at least the exterior wall or walls of a building structure comprising:

(a) erecting on a foundation a number of spaced upright beams, each beam including one or more zig-zag reinforcing bars extending in a generally upright direction, (b) attaching shuttering sheets on either side of said beams so that the points of the reinforcing bars project through the shuttering sheets, the shuttering sheets spanning the space between adjacent beams and opposed shuttering sheets defining between themselves a cavity, said shuttering sheets are attached to said beams by forcing the points of the zig-zag bars through the material of the sheets, (c) attaching at least one metal reinforcement mesh over each respective shuttering sheet to the points of the reinforcing bars projecting through that shuttering sheet, and (d) spraying cementitious material against each shuttering sheet through the respective metal reinforcement mesh so as to form a layer against each shuttering sheet in which the metal reinforcement mesh is embedded and the points of the zig-zag reinforcing bars which project through the shuttering sheet are embedded and anchored so that the two layers of cementitious material become tied to one another by the zig-zag reinforcing bars.

13. A method according to claim 12 in which said shuttering sheets are sheets of expanded polystyrene.

* * * * *